US010263341B2

(12) United States Patent
Desclos et al.

(10) Patent No.: US 10,263,341 B2
(45) Date of Patent: Apr. 16, 2019

(54) LOW PROFILE ANTENNA SYSTEM

(71) Applicant: ETHERTRONICS, INC., San Diego, CA (US)

(72) Inventors: Laurent Desclos, San Diego, CA (US); Jeffrey Shamblin, San Diego, CA (US)

(73) Assignee: ETHERTRONICS, INC., San Diego, CA (US)

( * ) Notice: Subject to any disclaimer, the term of this patent is extended or adjusted under 35 U.S.C. 154(b) by 0 days.

(21) Appl. No.: 15/491,960

(22) Filed: Apr. 19, 2017

(65) Prior Publication Data

US 2017/0301998 A1 Oct. 19, 2017

Related U.S. Application Data

(60) Provisional application No. 62/324,840, filed on Apr. 19, 2016.

(51) Int. Cl.

| | |
|---|---|
| ***H01Q 9/16*** | (2006.01) |
| ***H01Q 9/04*** | (2006.01) |
| ***H01Q 1/38*** | (2006.01) |
| ***H01Q 1/42*** | (2006.01) |
| ***H01Q 5/328*** | (2015.01) |
| ***H01Q 5/378*** | (2015.01) |

(52) U.S. Cl.

CPC ..... *H01Q 9/0421* (2013.01); *H01Q 1/38* (2013.01); *H01Q 1/42* (2013.01); *H01Q 5/328* (2015.01); *H01Q 5/378* (2015.01); *H01Q 9/0442* (2013.01); *H01Q 9/16* (2013.01)

(58) Field of Classification Search

CPC ..... H01Q 9/0421; H01Q 9/16; H01Q 9/0442; H01Q 5/328; H01Q 5/378

USPC ..... 343/745

See application file for complete search history.

(56) References Cited

U.S. PATENT DOCUMENTS

| | | | | |
|---|---|---|---|---|
| 4,700,194 | A * | 10/1987 | Ogawa | H01Q 9/0421 343/700 MS |
| 4,835,538 | A * | 5/1989 | McKenna | H01Q 9/0414 343/700 MS |
| 4,907,006 | A * | 3/1990 | Nishikawa | H01Q 1/32 343/700 MS |
| 6,040,803 | A * | 3/2000 | Spall | H01Q 1/243 343/700 MS |
| 6,281,843 | B1 * | 8/2001 | Evtioushkine | H01Q 1/38 343/700 MS |
| 6,292,154 | B1 * | 9/2001 | Deguchi | H01Q 1/243 343/795 |
| 6,717,551 | B1 | 4/2004 | Desclos et al. | |
| 6,744,410 | B2 | 6/2004 | Shamblin et al. | |
| 6,906,667 | B1 | 6/2005 | Poilasne et al. | |

(Continued)

*Primary Examiner* — Lam T Mai

(74) *Attorney, Agent, or Firm* — Dority & Manning, P.A.

(57) ABSTRACT

An antenna system is described where uniform radiation pattern coverage is provided in the plane of a low profile antenna element. A polarization that is orthogonal to the plane of the low profile antenna element can be achieved for the radiated field. Tuning mechanisms are described to provide a method for dynamically altering the radiation pattern and for adjusting the frequency response of the antenna during the manufacturing process as well as at field installation. The antenna system is capable of being implemented in applications such as local area network (LAN), cellular communication network, and machine to machine (M2M).

21 Claims, 7 Drawing Sheets

(56) References Cited

U.S. PATENT DOCUMENTS

| | | | | |
|---|---|---|---|---|
| 7,123,209 | B1 | 10/2006 | Desclos et al. | |
| 9,413,062 | B2 | 8/2016 | Ortiz | |
| 9,923,260 | B2 | 3/2018 | Desclos et al. | |
| 10,084,240 | B2 | 9/2018 | Shamblin et al. | |
| 2002/0126051 | A1* | 9/2002 | Jha | H01Q 9/0421 343/702 |
| 2003/0201942 | A1 | 10/2003 | Poilasne et al. | |
| 2013/0285877 | A1 | 10/2013 | Desclos et al. | |
| 2017/0301996 | A1* | 10/2017 | Desclos | H01Q 9/0407 |

* cited by examiner

LOW PROFILE ANTENNA SYSTEM

CROSS-REFERENCE TO RELATED APPLICATIONS

This application claims benefit of U.S. Provisional Ser. No. 62/324,840, filed Apr. 19, 2016, titled "LOW PROFILE ANTENNA SYSTEM"; the entire contents of which are hereby incorporated by reference.

BACKGROUND OF THE INVENTION

Field of the Invention

This invention relates generally to the field of wireless communication. In particular, the invention relates to an antenna system configured to provide low profile attributes and tuning capabilities.

Description of the Related Art

A proliferation of wireless communication systems such as wireless wide area networks (WWANs) also referred to as "cellular systems", wireless local area networks (WLANs), machine to machine (M2M) systems, and internet of things (IoT) applications, has increased the number and types of devices and infrastructure that antennas are, or will, need to be designed into and/or integrated with.

Some M2M applications can be demanding when a low profile antenna is required, specifically when the height allocated for the antenna is not sufficient for efficient operation at the required frequency.

If the antenna is operating at an industrial scientific and medical (ISM) frequency band such as, for example, 434 MHz or 915 MHz, the height required for efficient antenna operation when placed at ground level might be such that the antenna introduces a trip hazard.

Ground level installation is of interest, for example, when M2M systems are used for utility metering or vehicle monitoring along roadways.

Many of the commercial wireless applications, such as M2M and IoT applications, require an antenna to transmit or receive equally well over wide fields of view since there could be motion involved in the application or a lack of consistency in communication system architecture such that the placement of communication nodes varies from one installation to the next.

In addition, a wide field of view or beam-width of the antenna is generally required for communication systems based on a cellular model, where communication nodes or base stations are positioned in a grid and require a client device or customer device containing an antenna to connect to base stations or nodes in multiple orientation angles.

When a low profile antenna module is required, and the frequency of operation is such that the height or thickness allowed for the antenna module is a fraction of a wavelength, it is generally difficult to achieve uniform radiation pattern coverage in a plane of the antenna that is normal to the axis aligned with the dimension of reduced height. Additionally, it is generally difficult to achieve uniform pattern coverage in the plane normal to the axis aligned with the dimension of reduced height when the polarization of the antenna is required to align with the axis normal to the dimension of reduced height. For example, it is generally difficult to design an antenna module with vertical polarization referenced to the ground when the antenna is required to be placed on the ground, especially when uniform coverage is required in the plane of the antenna.

For antennas with reduced height requirements at frequencies where the height of the antenna is a fraction of a wavelength a typical characteristic of the antenna will be reduced frequency bandwidth. The reduced bandwidth of the antenna design can act to reduce yield during production runs, pointing to a need to have a tuning feature in the design to allow for adjusting the frequency response during the manufacturing process.

There is a need for improved low profile antennas having good performance and tuning capabilities.

SUMMARY

An antenna system is described, where omni-directional radiation pattern performance is achieved with the dominant polarization being normal to the plane that contains the dominant two dimensions of the antenna in a reduced height form factor. A tuning function is provided where the resonant frequency can be adjusted during the manufacturing process and/or during communication system operation. A method of dynamic radiation pattern adjustment is also provided. This antenna system is useful for applications where vertical polarization is required from low profile antennas place on the ground such that the antenna does not present a trip hazard.

BRIEF DESCRIPTION OF THE DRAWINGS

These and other aspects are described in the appended details and descriptions, particularly when referenced in conjunction with the following drawings, wherein.

DESCRIPTION OF EMBODIMENTS

Figure 1:
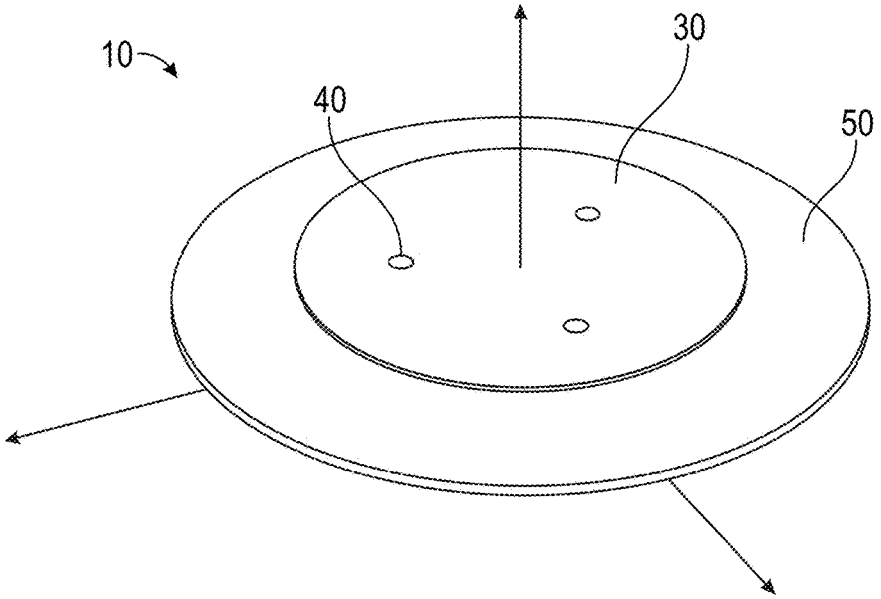
FIG. 1 shows a perspective view of a low profile antenna with three tuning elements in accordance with a first illustrated embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments. However, a myriad of other embodiments which will not be expressly described will be readily understood by those having skill in the art upon a thorough review hereof. Accordingly, any reviewer of the instant disclosure should interpret the scope of the invention by the claims, and such scope shall not be limited by the embodiments described and illustrated herein.

In a general embodiment, a low profile antenna system is provided. The antenna system is capable of variable tuning and good performance for applications where the antenna is installed on a walking surface.

In one embodiment of the antenna system, a radiating element is positioned above a ground plate. The radiating element takes the form of an area and this area can be shaped as a circle, square, rectangle, or other shape. The radiating element is positioned very close to the ground plate, typically a few hundredths of a wavelength associated with the antenna, or more preferably, between one to five hundredths of the associated wavelength. The radiating element can be positioned parallel to the ground plate, but this is not a requirement. One or multiple tuning elements, such as straps or shorting pins, are used to electrically connect the radiating element to the ground plate. The one or multiple tuning elements are positioned symmetrically around a perimeter of the radiating element.

For example, if the radiating element is a circular round disc and if three tuning elements are used to connect the radiating element to the ground plate, the three tuning elements are positioned every 120 degrees around the periphery of the disc. The three tuning elements can provide a vertical connection between the radiating element and the ground plate, or the tuning elements can be made longer and angled downward by extending from a periphery of the radiating element to a periphery of the ground plate. A feed conductor is coupled to a center of the radiating element and is configured to excite the antenna. This feed conductor can be a direct connection using the center conductor of a coaxial cable used to connect the antenna to a transceiver. Alternately, a conductor such as a wire or planar element can be used to connect to the radiating element, with this conductor in turn connected to the transmission line.

In another embodiment, the feed conductor can be made such that it is a capacitive feed, where the conductor used to couple to the radiating element does not make contact. Instead of a wire a planar conductor in the shape of a rectangle can be used to couple the radiating element to the transceiver. A portion of the planar conductor can be positioned in close proximity to the radiating element such that an electric field is set-up between the planar conductor and the radiating element. The width of the conductor can be selected to increase or decrease the amount of capacitance between the radiating element and conductor. This capacitive coupling feature which eliminates the physical connection of a wire or conductor at the feed location on the radiating element can result in a more reliable antenna configuration when the antenna is subjected to stresses and physical impacts.

In another embodiment, one of the tuning elements may include a tunable capacitor. One terminal of the tunable capacitor is connected to the radiating element and the second terminal is connected to the ground plate. This tunable capacitor can be a mechanical assembly, such as a planar conductor element that is positioned closer or further from a bottom surface of the radiating element, with the planar conductor element connected to the ground plate. In this configuration, a capacitance is formed between the radiating element and the ground plate, and the distance between the planar conductor element and the radiating element can be used to adjust the amount of capacitance. The change in capacitance at the tuning element location will result in a shift in frequency of the antenna and this feature can be used to alter the frequency of antennas during the manufacturing process, or after installing the antenna in a communication system.

By adjusting the capacitance of a single tunable capacitor in a three or four tuning element antenna design, the radiation pattern can be altered such that it is not omni-directional in the plane of the antenna, with the radiation pattern instead having a peak gain response in a desired direction.

In another embodiment, the tunable capacitor may include a component type capacitor that can be tuned by applying an electrical signal. Transistor and diode based capacitors are in this category, along with Barium Stronium Titanate (BST) capacitors. MicroElectroMechanical systems (MEMS) capacitors can also be used, with these MEMS devices being hybrid electrical/mechanical structures. The type of tunable capacitors listed here allow for tuning of the capacitor to be performed using an electrical control signal, and also allows for faster tuning to occur compared to a mechanical tunable capacitor. The faster tuning allows for the frequency response of the antenna to be dynamically adjusted, allowing for compensation for environmental effects during operation of the antenna with a communication system.

In another embodiment, all tuning elements in the antenna design remain and a tunable capacitor is positioned at a location beneath the radiating element to provide a tuning mechanism. The tuning elements are positioned and designed to tune the frequency response of the antenna to the required frequency range, with the tunable capacitor used to provide a fine tuning adjustment during the manufacturing process, or a method of tuning the antenna in the field during operation to compensate for changes in the environment of the antenna. In this configuration, a capacitance is formed between the radiating element and the ground plate, and the distance between the planar conductor element and the radiating element can be used to adjust the amount of capacitance. The change in capacitance at the tuning element location will result in a shift in frequency of the antenna and this feature can be used to alter the frequency of antennas during the manufacturing process or after installing the antenna in a communication system.

The antennas described herein may be implemented with water meters and similar devices. The antenna may include three tuning elements surrounding a feed, used to make the radiation pattern omni-directional. In certain embodiments, one or more of the tuning elements may comprise a tunable capacitor and adjust the pattern to point or look in a specific direction.

Now turning to the drawings, FIG. 1 shows a perspective view of a low profile antenna 10 with three tuning elements 40 in accordance with a first illustrated embodiment. Here, the antenna includes a radiating element 30 and an optional thermoplastic carrier 55. The thermoplastic carrier can be a molded piece which is injection molded, or over molded, to be integrated with the radiating element and ground plate to form the antenna system.

Figure 2:
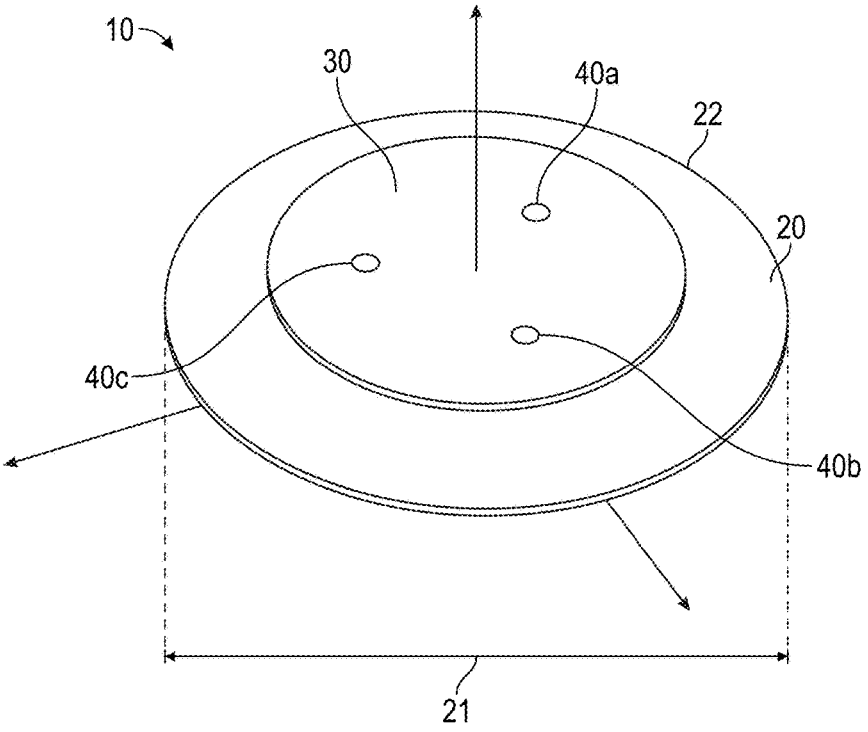
FIG. 2 shows a radiating element positioned above a ground plate of the antenna system in accordance with the first illustrated embodiment.

FIG. 2 shows a radiating element 30 positioned above a ground plate 20 of the antenna system 10 in accordance with the first illustrated embodiment. Here it is shown the tuning elements 40*a*; 40*b*; 40*c* each coupled to the radiating element 30 and extending downwardly therefrom. The ground plate 20 comprises a first periphery 22 associated therewith. Also shown is a first diameter 21 of the ground plate.

Figure 3:
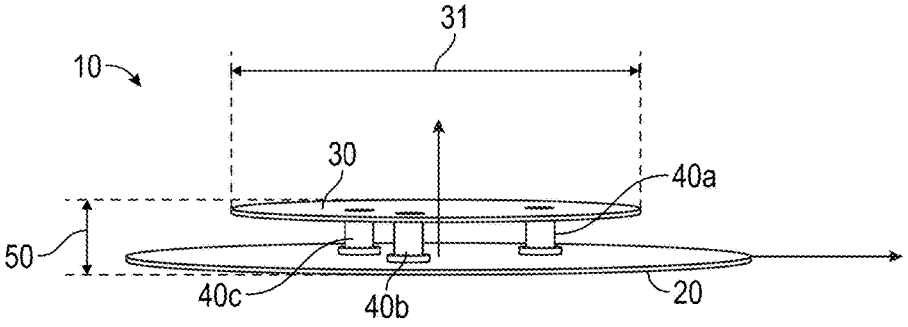
FIG. 3 shows a side view of the low profile antenna in accordance with the first embodiment.

FIG. 3 shows a side view of the low profile antenna 10 in accordance with the first embodiment. The radiating element 30 is positioned above the ground plate 20, and tuning elements 40*a*; 40*b*; and 40*c* are shown extending from the radiating element to the ground plate. The radiating element is separated from the ground plate by gap 50. The radiating element further comprises a second diameter 31 associated therewith, wherein the second diameter is less than the first diameter of the ground plate. Also shown is feed conductor 60 extending from a center of the radiating element to the ground plate 20.

Figure 4:
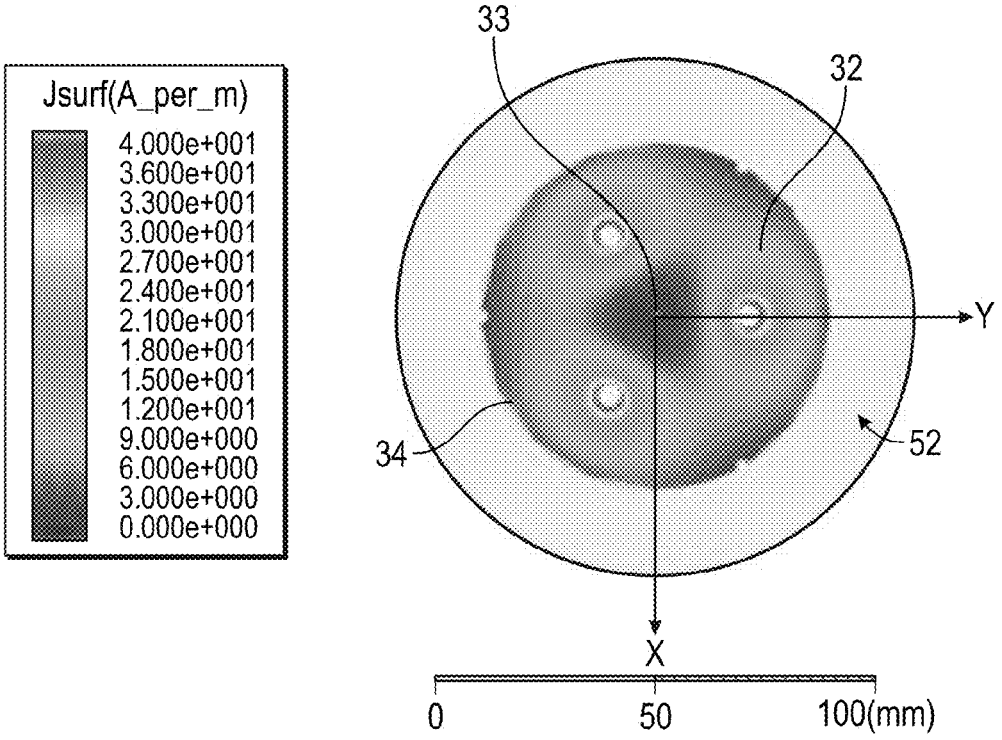
FIG. 4 shows a current distribution on a 450 MHz antenna in accordance with the first illustrated embodiment.

FIG. 4 shows a current distribution 52 on a 450 MHz antenna in accordance with the first illustrated embodiment. The radiating element includes a surface 32 bound by a radiating element periphery 34. The radiating element is shown with a center 33. The current distribution 52 can be appreciated from the representations in this figure.

Figure 5:
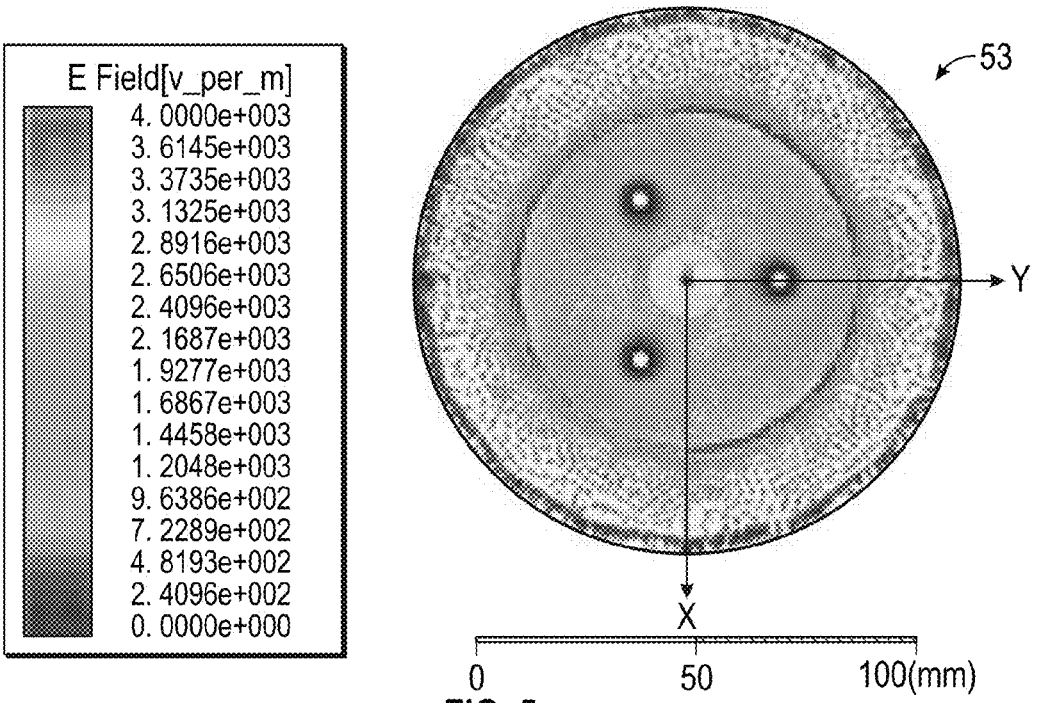
FIG. 5 shows a top view of the antenna in accordance with the first illustrated embodiment and an electric field associated therewith.

FIG. 5 shows a top view of the antenna in accordance with the first illustrated embodiment and an electric field 53 associated therewith.

Figure 6:
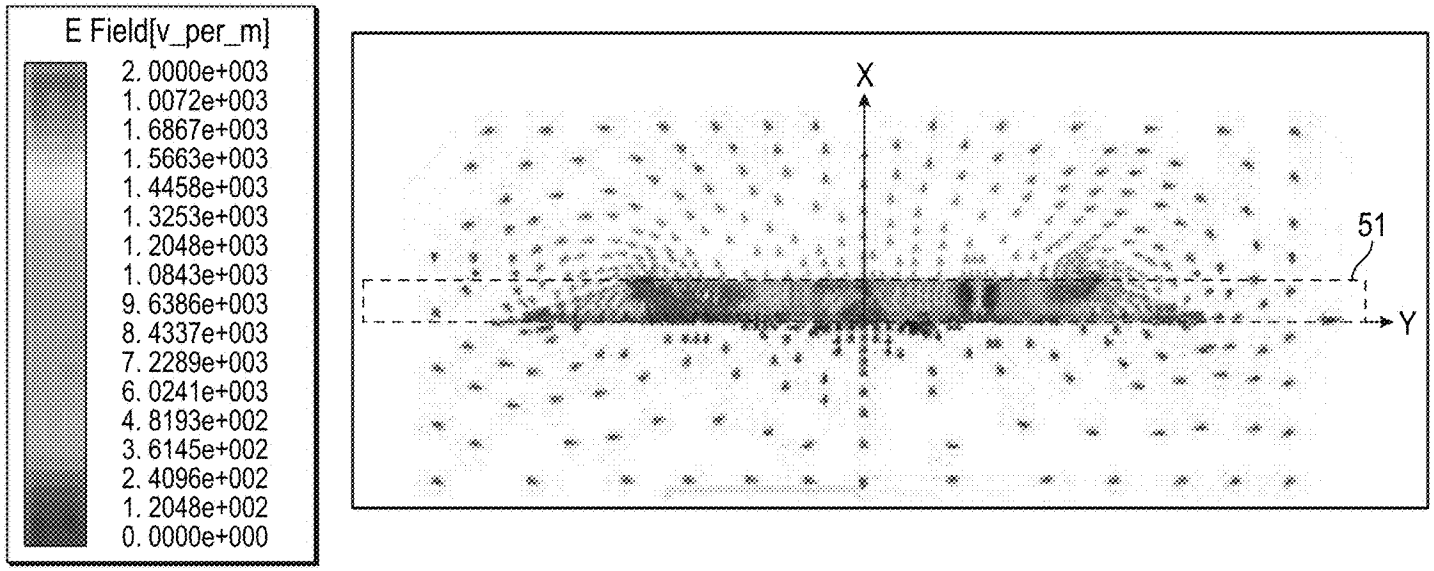
FIG. 6 shows a side view of the antenna in accordance with the first illustrated embodiment and an electric field associated therewith.

FIG. 6 shows a side view of the antenna in accordance with the first illustrated embodiment and an electric field associated therewith. Also shown is the radiating element and ground plate being disposed within a common plane 51.

Figure 7:
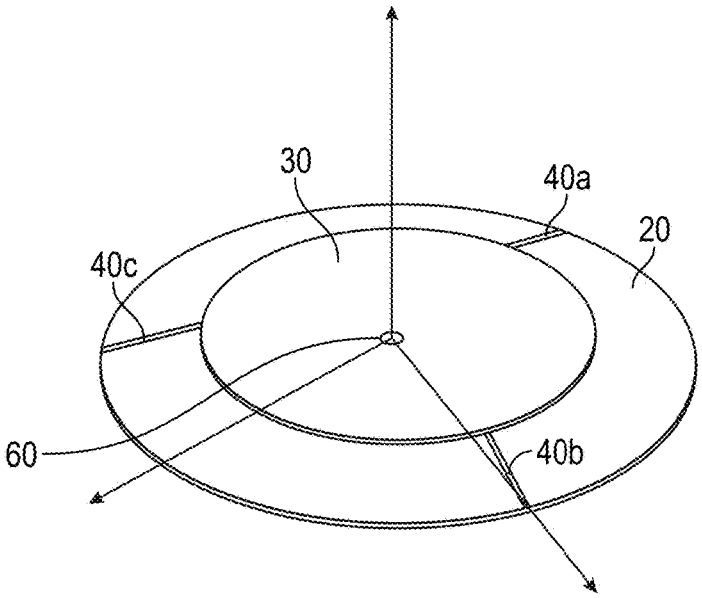
FIG. 7 shows a perspective view of an antenna system in accordance with a second illustrated embodiment.

FIG. 7 shows a perspective view of an antenna system in accordance with a second illustrated embodiment. Here, a radiating element 30 is coupled to a ground plate 20 via three tuning elements 40*a*; 40*b*; and 40*c* extending therebetween. Here, the tuning elements are not vertically oriented, but instead are configured to extend from the periphery of the radiating element to the periphery of the ground plate thereby each tuning element is oriented at angle with respect to the common plane. Also shown is a planar feed conductor 60.

Figure 8:
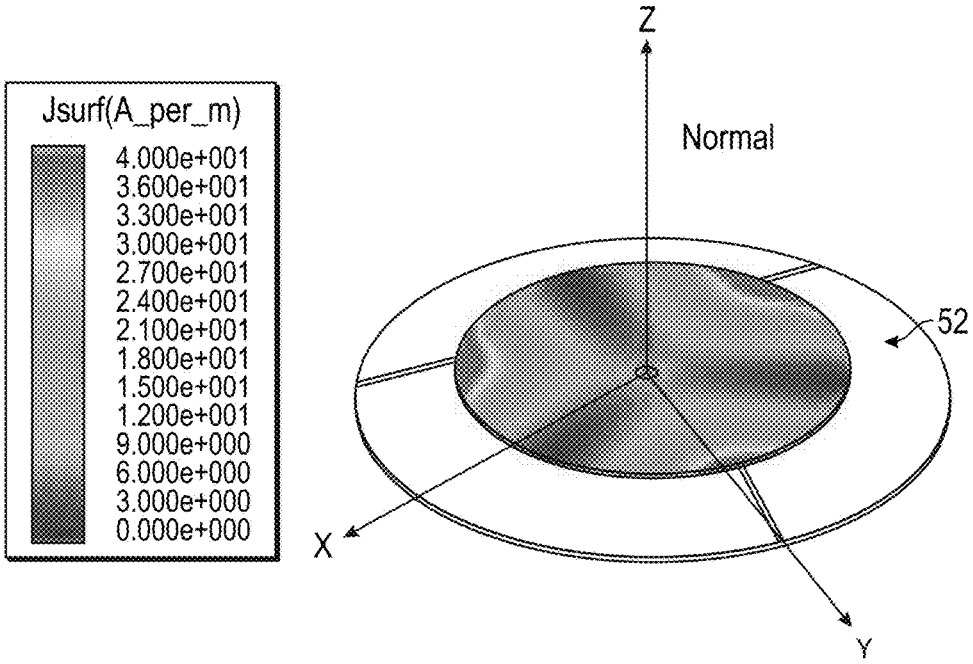
FIG. 8 shows a current distribution on a 450 MHz antenna in accordance with the second illustrated embodiment.

FIG. 8 shows a current distribution 52 on a 450 MHz antenna in accordance with the second illustrated embodiment. Here it is illustrated that the antenna in this embodiment provides a triangular current distribution across the radiating element.

Figure 9:
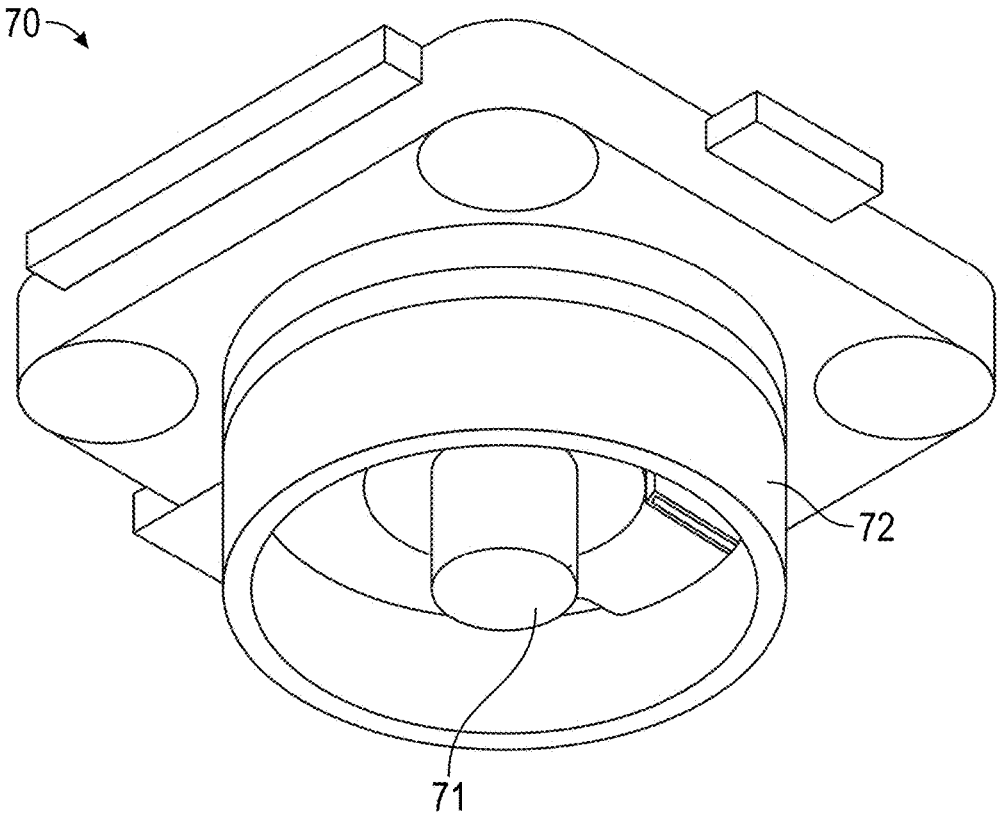
FIG. 9 shows a coaxial cable connector.

FIG. 9 shows a conventional coaxial cable connector 70 having a center pin 71 and a connector body 72. While the instant connector is shown, it will be understood by one having skill in the art that any connector may be similarly implemented without departing from the spirit and scope of the invention.

Figure 10:
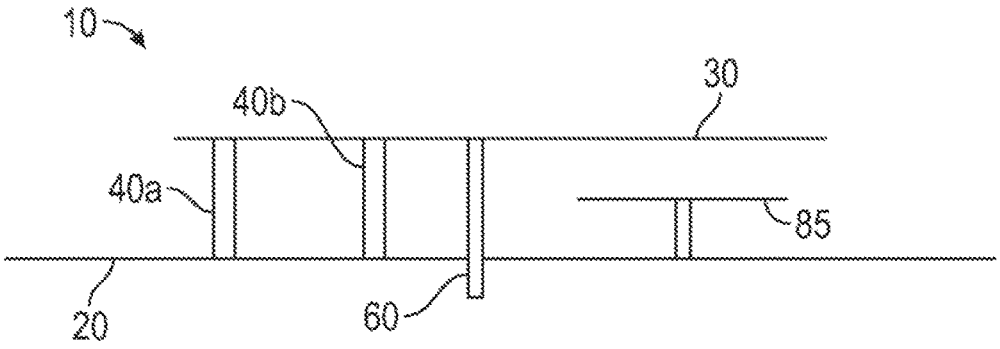
FIG. 10 shows a side view of a low profile antenna system in accordance with a third illustrated embodiment wherein a planar conductor element is disposed between the radiating element and the ground plate.

FIG. 10 shows a side view of a low profile antenna system 10 in accordance with a third illustrated embodiment wherein a planar conductor element 85 is disposed between the radiating element 30 and the ground plate 20. The tuning elements 40*a*; 40*b* are shown extending from the radiating element to the ground plate. Feed conductor 60 is shown extending downwardly from the radiating element.

Figure 11:
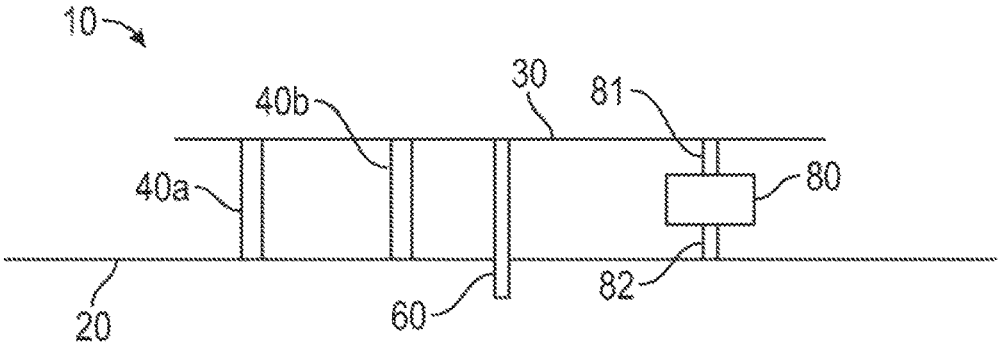
FIG. 11 shows a side view of a low profile antenna system in accordance with a fourth illustrated embodiment wherein a tunable capacitor is disposed between the radiating element and the ground plate.

FIG. 11 shows a side view of a low profile antenna system 10 in accordance with a fourth illustrated embodiment wherein a tunable capacitor 80 is disposed between the radiating element 30 and the ground plate 20. The tunable capacitor comprises a first terminal 81 coupled to the radiating element 30, and a second terminal 82 coupled to the ground plate. The tuning elements 40*a*; 40*b* are shown extending from the radiating element to the ground plate. Feed conductor 60 is shown extending downwardly from the radiating element.

Accordingly, an antenna system has been described herein, the antenna system comprising: a ground plate having a first diameter and a first periphery associated therewith; a radiating element positioned above the ground plate forming a gap therebetween, the radiating element having a second diameter, wherein the second diameter is less than the first diameter; and three tuning elements, each of the three tuning elements being arranged in a symmetrical disposition about a surface of the radiating element and extending from the radiating element to the ground plate. Each of the ground plate and radiating element may be disposed in a common plane. In some embodiments, the antenna system is configured to produce a dominant polarization in a direction normal to the common plane.

In some embodiments, the antenna system further comprises a feed conductor coupled to the radiating element. The feed conductor can be coupled to the radiating element at a center thereof. A coaxial cable connector can be provided, wherein the feed conductor is coupled to a center pin of the coaxial cable connector. The feed conductor can be capacitively coupled to the radiating element. In some embodiments, the feed conductor can comprise a planar shape.

While the illustrated embodiments show the radiating element comprising a circular shape, other shapes can be similarly implemented.

The radiating element is generally separated from the ground plate by a distance between one and five hundredths of a wavelength associated with the radiating element, thereby forming a low profile antenna. In some embodiments, the radiating element is oriented parallel to the ground plate.

Tuning elements are disclosed, wherein each of the tuning elements is arranged to vertically extend from the radiating element to the ground plate, or in accordance with other embodiments, each of the tuning elements can be arranged to extend from a periphery of the radiating element to the first periphery of the ground plate. In some embodiments, the radiating element can be configured to produce a triangular shaped current distribution on a surface thereof.

Other embodiments provide that at least one of the tuning elements comprises a tunable capacitor, wherein a first terminal of the tunable capacitor is connected to the radiating element, and wherein a second terminal of the tunable capacitor is coupled to the ground plate.

In other embodiments, the tunable capacitor is selected from the group consisting of: a variable capacitor, barium strontium titanate (BST) capacitor, microelectrical mechanical systems (MEMS) device, transistors, and diodes.

The antenna system may comprise a planar conductor element disposed between the radiating element and the ground plate, the planar conductor element being coupled to the ground conductor plate.

In general, the antenna system can be adapted for dynamic adjustment of a frequency response associated therewith.

While certain details and descriptions have been provided herein for the purpose of illustrating to one having skill in the art how to make and use the invention, it should be understood that other features, embodiments and arrangements of the elements herein can be appreciated without departing from the spirit and scope of the invention as-claimed.

FEATURE LIST antenna system (10)
ground plate (20)
first diameter of ground plate (21)
first periphery of ground plate (22)
radiating element (30)

second diameter (31)
radiating element surface (32)
radiating element center (33)
radiating element periphery (34)
tuning element (40)
gap (50)
common plane (51)
current distribution (52)
electric field (53)
thermoplastic carrier (55)
feed conductor (60)
coaxial cable connector (70)
center pin (71)
connector body (72)
tunable capacitor (80)
first terminal (81)
second terminal (82)
planar conductor element (85)

What is claimed is:

1. An antenna system, comprising:

a ground plate having a first diameter and a first periphery associated therewith;

a radiating element positioned above the ground plate forming a gap therebetween, the radiating element having a second diameter, wherein the second diameter is less than the first diameter; and three tuning elements, each of the three tuning elements being arranged in a symmetrical disposition about a surface of the radiating element and extending from the radiating element to the ground plate.

2. The antenna system of claim 1, wherein each of the ground plate and radiating element are disposed in a common plane.

3. The antenna system of claim 2, wherein the antenna system is configured to produce a dominant polarization in a direction normal to the common plane.

4. The antenna system of claim 1, further comprising a feed conductor coupled to the radiating element.

5. The antenna system of claim 3, wherein the feed conductor is coupled to the radiating element at a center thereof.

6. The antenna system of claim 4, further comprising a coaxial cable connector, wherein the feed conductor is coupled to a center pin of the coaxial cable connector.

7. The antenna system of claim 4, wherein the feed conductor is capacitively coupled to the radiating element.

8. The antenna system of claim 7, wherein the feed conductor comprises a planar shape.

9. The antenna system of claim 1, wherein the radiating element comprises a circular shape.

10. The antenna system of claim 1, wherein the radiating element is separated from the ground plate by a distance between one and five hundredths of a wavelength associated with the radiating element.

11. The antenna system of claim 1, wherein the radiating element is oriented parallel to the ground plate.

12. The antenna system of claim 1, wherein each of the tuning elements is arranged to vertically extend from the radiating element to the ground plate.

13. The antenna system of claim 1, wherein each of the tuning elements is arranged to extend from a periphery of the radiating element to the first periphery of the ground plate.

14. The antenna system of claim 13, wherein the radiating element is configured to produce a triangular shaped current distribution on a surface thereof.

15. The antenna system of claim 1, further characterized in that:

at least one of the tuning elements comprises a tunable capacitor, a first terminal of the tunable capacitor is connected to the radiating element, and a second terminal of the tunable capacitor is coupled to the ground plate.

16. The antenna system of claim 15, wherein the tunable capacitor is selected from the group consisting of: a variable capacitor, barium strontium titanate (BST) capacitor, micro-electrical mechanical systems (MEMS) device, transistors, and diodes.

17. The antenna system of claim 1, comprising a planar conductor element disposed between the radiating element and the ground plate, the planar conductor element being coupled to the ground conductor plate.

18. The antenna system of claim 1, wherein the antenna system is adapted for dynamic adjustment of a frequency response associated therewith.

19. The antenna system of claim 1, further comprising a tunable capacitor.

20. An antenna system, comprising:

a ground plate;

a radiating element positioned above the ground plate forming a gap therebetween;

one or more tuning elements, each of the tuning elements extending between the radiating element and the ground plate, each of the tuning elements connected to the ground plane;

wherein the gap is less than five hundredths of a wavelength associated with the radiating element.

21. The antenna system of claim 20, comprising four tuning elements.

* * * * *